US006116412A

United States Patent [19]

Rogers

[11] Patent Number: 6,116,412

[45] Date of Patent: Sep. 12, 2000

[54] ANCHORING EYEGLASS POUCH

[76] Inventor: Anne E. Rogers, 225 Monhagen Ave., Middletown, N.Y. 10940

[21] Appl. No.: 09/193,942

[22] Filed: Nov. 18, 1998

[51] Int. Cl.[7] ..... A45C 11/04

[52] U.S. Cl. ..... 206/5; 206/6; 206/806; 206/818; 383/11

[58] Field of Search ..... 206/516, 37, 38, 206/806, 818; 383/11, 23

[56] References Cited

U.S. PATENT DOCUMENTS

| | | | |
|---|---|---|---|
| D. 348,475 | 7/1994 | Kahari . | |
| D. 371,679 | 7/1996 | Nejman . | |
| 1,842,599 | 1/1932 | Fraser . | |
| 3,051,130 | 8/1962 | Morris | 206/818 |
| 3,741,376 | 6/1973 | Brown et al. | 206/5 |
| 3,994,391 | 11/1976 | Holland | 206/5 |
| 4,267,923 | 5/1981 | Baratelli et al. . | |
| 4,951,811 | 8/1990 | Lines . | |
| 5,123,525 | 6/1992 | Orlowski | 206/5 |
| 5,240,105 | 8/1993 | Tsai . | |
| 5,366,072 | 11/1994 | Goldenberg . | |
| 5,370,246 | 12/1994 | Traynor | 383/11 |
| 5,533,809 | 7/1996 | Gorman | 383/11 |
| 5,598,923 | 2/1997 | Owens | 206/818 |
| 5,687,837 | 11/1997 | Seiler . | |
| 5,758,972 | 6/1998 | Mack et al. | 383/11 |

FOREIGN PATENT DOCUMENTS

| | | | |
|---|---|---|---|
| 2234872 | 1/1975 | France | 206/5 |

*Primary Examiner*—Paul T. Sewell
*Assistant Examiner*—Luan K. Bui

[57] ABSTRACT

Disclosed is a storage pouch article that is used to store eyeglasses in a secure and protective manner. The storage pouch is generally rectangular in shape with a pouch sewn into its mid-section, designed to accept a pair of eyeglasses, and has weighted sections at each end. The weighted sections serve to anchor the pouch on a support surface in order to reduce the chances for knocking them down or sliding therefrom under their own weight.

5 Claims, 5 Drawing Sheets

ANCHORING EYEGLASS POUCH

BACKGROUND OF THE INVENTION

1. Field of the Invention

The present invention relates generally to eyeglass storage and protection devices, and more specifically to a protective eyeglass storage pouch that incorporates a variety of anchoring means that allow for securing the eyeglass pouch to a variety of surfaces and structures.

2. Description of the Related Art

Those required to wear corrective lenses are often faced with find a safe place to put their eyeglasses during the times when they are not being worn. Whether it be while sleeping, during activities that do not require their use, at the hair dresser or at the doctor's office, one places these expensive and delicate items at risk of suffering a variety of damage simply by setting them down. Eyeglasses are often knocked off their resting place, kicked, stepped on, sat on and otherwise damaged in degrees ranging from scratched lenses and bent frames to complete ruin. Accordingly, there is a need for a means by which one can remove and store his or her eyeglasses in a safe manner while maintaining easy access to them. The development of the present invention fulfills this need by providing a protective eyeglass storage pouch that incorporates a variety of anchoring means that allow for securing the eyeglass pouch to a variety of surfaces and structures.

A search of the prior art did not disclose any patents that read directly on the claims of the instant invention. However, several references to eyeglass storage and protection case and pouch devices were discovered and considered relevant.

Several patents describe an eyeglass pouches or cases that serve as a protective and storage purpose:

U.S. Pat. No. 5,687,837, issued in the name of Seiler;

U.S. Pat. No. 5,240,105, issued in the name of Tsai;

U.S. Pat. No. 4,267,923, issued in the name of Baratelli et. al.; and

U.S. Pat. No. 1,842,599, issued in the name of Fraser.

Two patents describe the design and function of an eyeglass holder that can be worn around the neck:

U.S. Pat. No. 5,366,072, issued in the name of Goldenberg; and

U.S. Pat. No. D 348,475, issued in the name of Kahaii.

Two following patents describe the function and design of eyeglass holder or case with dual pouches:

U.S. Pat. No. 4,951,811, issued in the name of Lines; and

U.S. Pat. No. D 371,679, issued in the name of Nejman.

While they all disclose protective and storage means for eyeglasses, none address the specific problems associated with placing the case in a location of convenient access. As such, these devices neither anticipate nor disclose any embodiment that would preclude its novelty and the utilitarian functionality of the features of the present invention, specifically the variety of anchoring means used to support the pouch from a variety of structures. While several features exhibited within these references may be incorporated into this invention, alone and in combination with other elements, the present invention is sufficiently different so as to make it distinguishable over the prior art.

SUMMARY OF THE INVENTION

The present invention is a storage pouch article, constructed mainly of a soft yet strong and durable fabric, that is used to store eyeglasses in a secure and protective manner. The storage pouch is generally rectangular in shape with a pouch sewn into its mid-section, designed to accept a pair of eyeglasses, and has weighted sections at each end. The weighted sections can consist of a variety of materials including, but not limited to metal bar, lead shot, magnets, polyethylene pellets or other suitable materials sewn into a separate compartment in the pouch material. The weighted sections serve to anchor the pouch on a flat surface in order to reduce the chances for knocking them down. The storage pouch can also be hung from headboard, towel rack or any other similar support structure by wrapping the weighted section over its edge. When used in this manner, the weighted section at the end opposite the supporting end serves to stabilize the pouch. Additionally, the incorporation of a magnet anchoring means allows for securing the pouch to a steel or other ferrous object or structure. As a result, the present invention allows the user to store his/her eyeglasses in a convenient and safe manner to a variety of structures and in a variety of scenarios.

It is therefore an object of the present invention to provide a protective eyeglass storage pouch that incorporates a variety of anchoring means that allow for securing the eyeglass pouch to a variety of surfaces and structures.

It is another object of the present invention to provide an anchoring eyeglass storage pouch prevent damage to eyeglasses stored therein caused dropping, knocking over or otherwise causing physical impact.

It is another object of the present invention to provide an anchoring eyeglass storage pouch that is constructed of a lightweight, strong and durable material.

Finally, it is an object of the present invention to provide an anchoring eyeglass storage pouch incorporating the use of readily available materials and a simple construction that will result in a cost-effective manufacture.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

LIST OF REFERENCE NUMBERS

10 Eyeglass Pouch
11 Pouch Portion

12 Anchoring Portion
13 Stabilizing Portion
14 Hollow Interior Cavity
15 Eyeglasses
20 Anchoring Weight
21 Stabilizing Weight
23 Hinging Portion
24 Hinging Reliefs
25 Securing Clip
30 Tabletop
31 Tabletop Edge
35 Drawer
36 Drawer Edge
37 Drawer Facade

DESCRIPTION OF THE PREFERRED EMBODIMENTS

1. Detailed Description of the Figures

Figure 1:
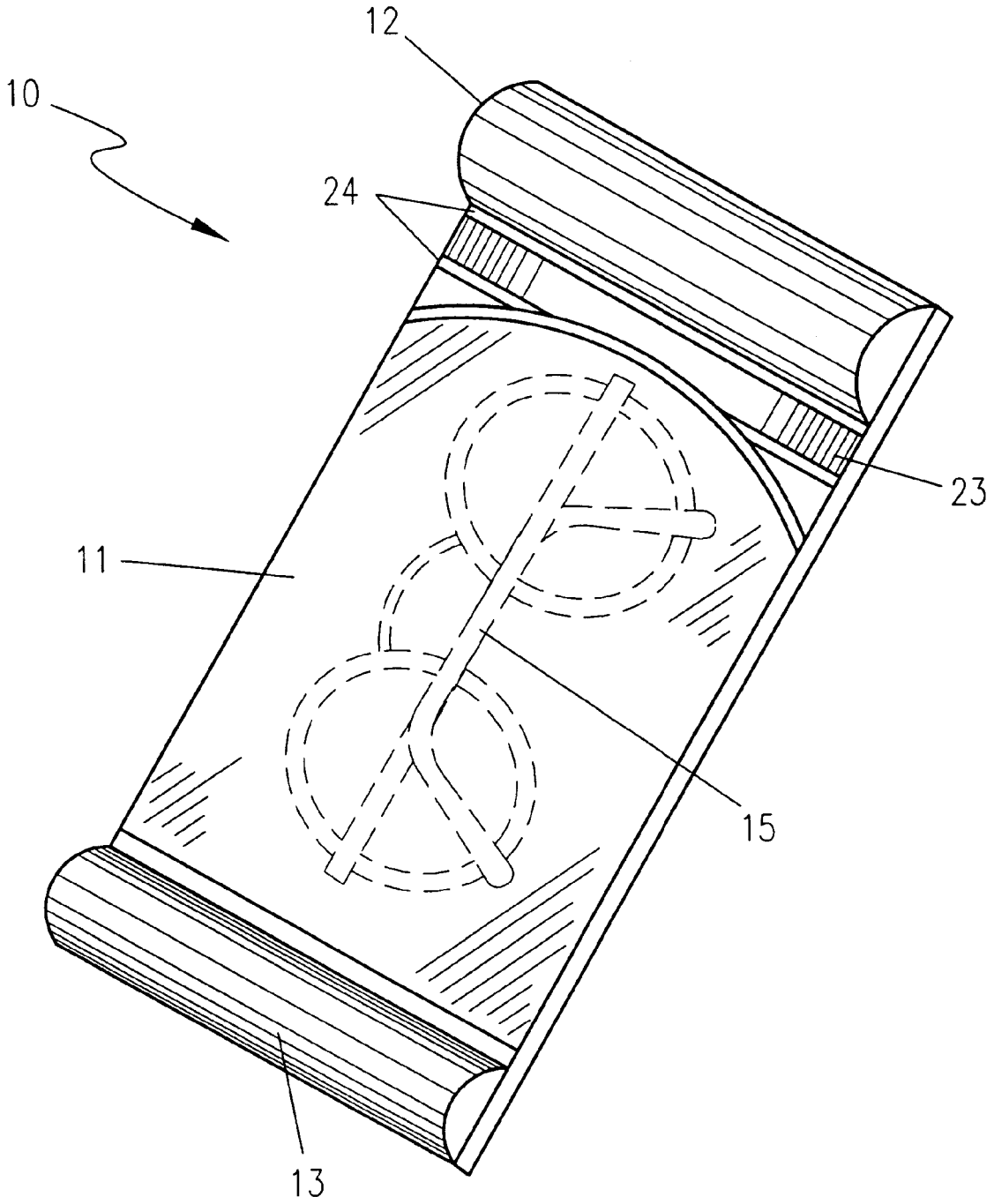
FIG. 1 is a perspective view of the anchoring eyeglass pouch, according to the preferred embodiment of the present invention.
Figure 2:
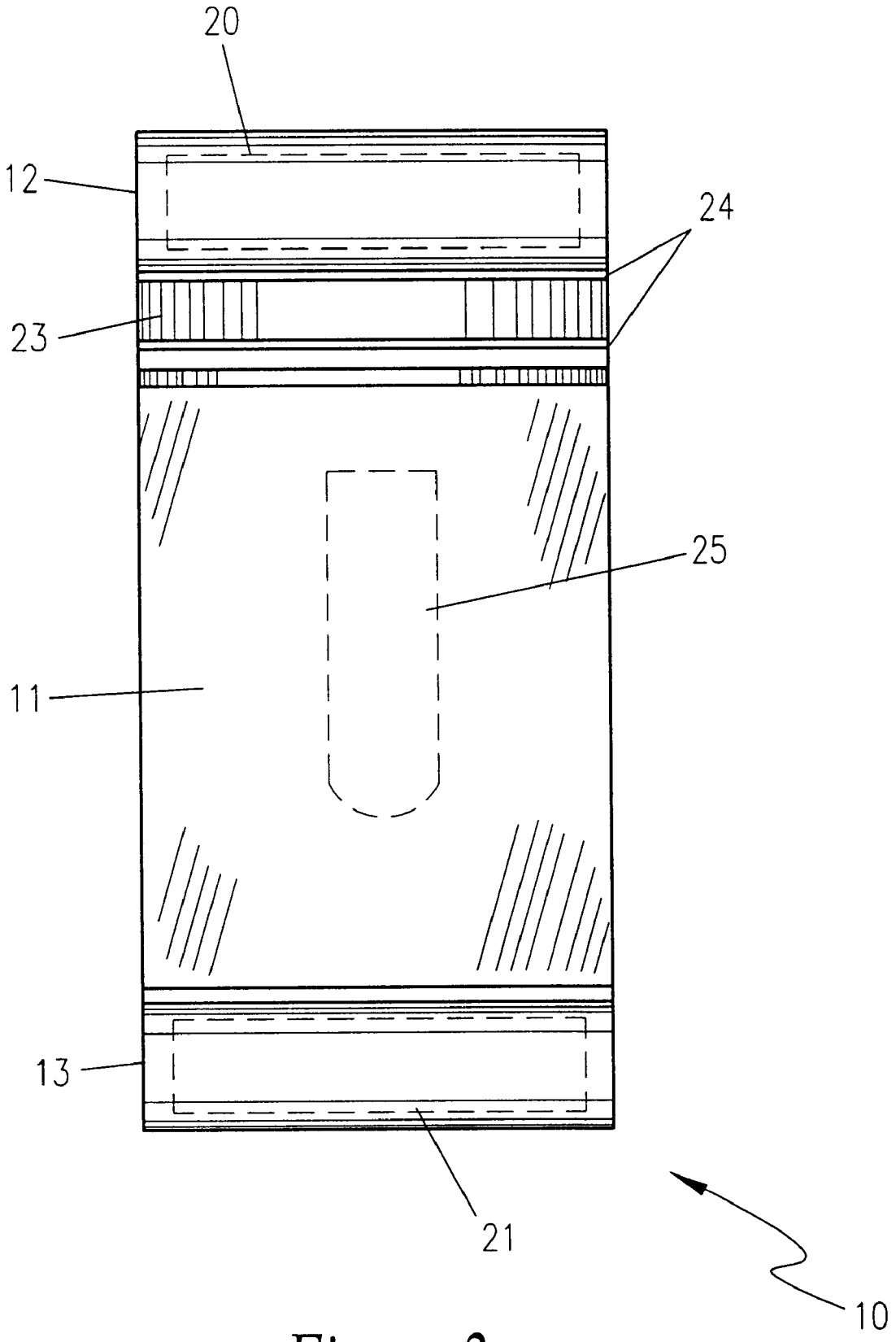
FIG. 2 is a front view of the anchoring eyeglass pouch, according to the preferred embodiment of the present invention.
Figure 3:
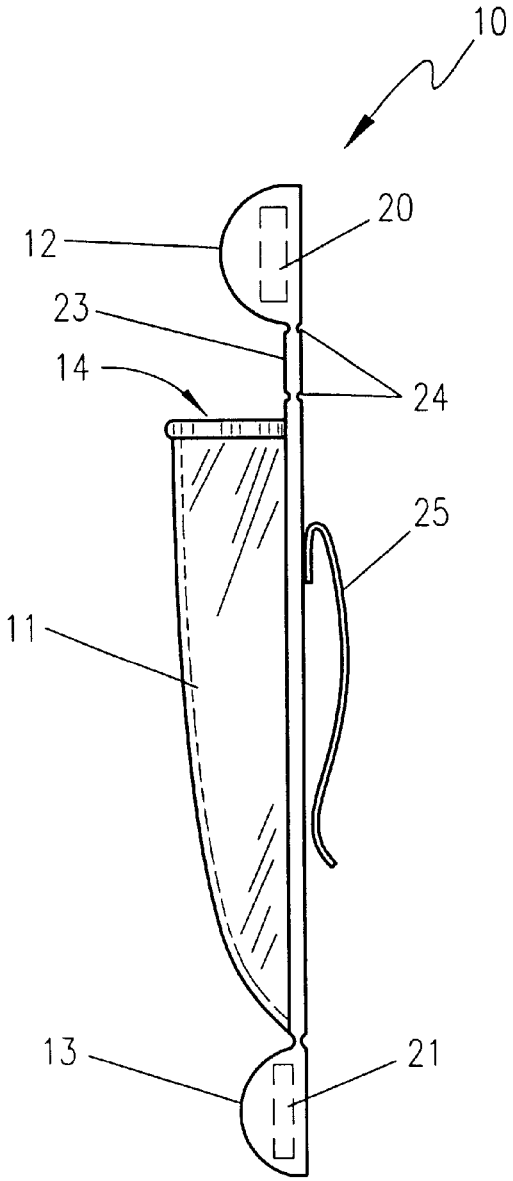
FIG. 3 is a side view of the anchoring eyeglass pouch, according to the preferred embodiment of the present invention.

Referring now to FIGS. 1–3, depicted is the anchoring eyeglass pouch 10, hereinafter eyeglass pouch 10, according to the preferred embodiment of the present invention. The eyeglass pouch 10 is generally rectangular in shape and has a pouch portion 11 located between an anchoring portion 12 and a stabilizing portion 13. Constructed of a strong, durable and flexible material such as nylon, canvas, plastic or other like material, the pouch portion 11 forms a hollow interior cavity 14 into which a pair of conventional eyeglasses 15 can be placed for protective and storage purposes. The flexible and resilient nature of the material construction of the pouch portion 11 causes a friction fit between the eyeglasses 15 and the eyeglass pouch 10, causing them to be retained therein. The anchoring portion 12 and the stabilizing portion 13 are configured as compartments that house an anchoring weight 20 and a stabilizing weight 21, respectively. The anchoring weight 20 and the stabilizing weight 21 may consist of a variety of materials including but not limited to a metal bar, lead shot, magnets, polyethylene pellets or other suitable materials, or a combination thereof, sewn into the compartmentalized pouch material that makes up the anchoring portion 12 and the stabilizing portion 13. The anchoring weight 20 is of a substantially greater mass than that of the stabilizing weight 21. A hinging portion 23 of material, located between and connecting the anchoring portion 12 to the pouch portion 11, includes a pair of hinging reliefs 24 that allow the anchoring portion 12 to swing pivotally with respect to the pouch portion 11. The hinging reliefs 24 consist of creases that are arranged perpendicularly with respect to the longitudinal axis of the eyeglass pouch 10.

Figure 3A:
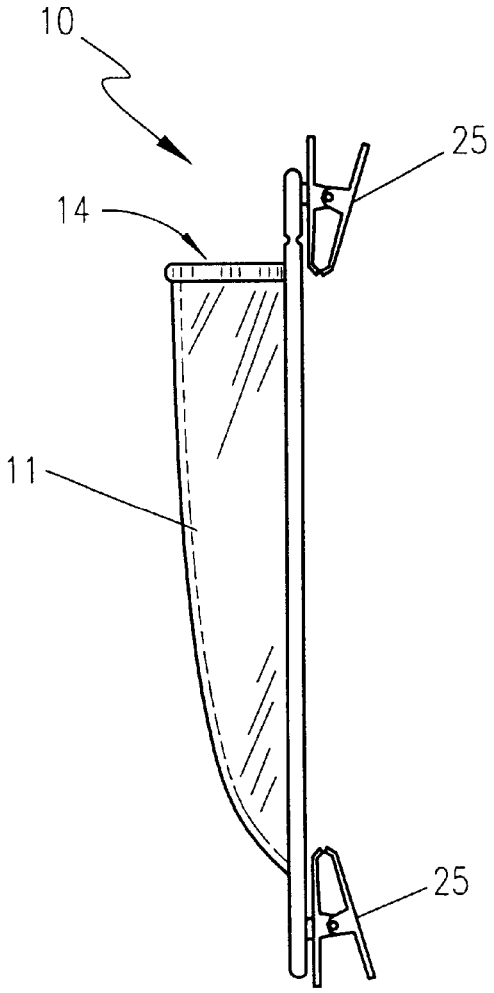
FIG. 3*a* is a side view of an anchoring eyeglass pouch, according to an alternate embodiment.

In an alternate embodiment as depicted in FIG. 3*a*, a pair of securing clips 25 provides an additional means by which to support the eyeglass pouch 10. The securing clips 25 consist of a spring biased clamping members located at opposite ends of the eyeglass pouch 10, replacing the anchoring portion 12 and the stabilizing portion 13.

2. Operation of the Preferred Embodiment

Figure 4:
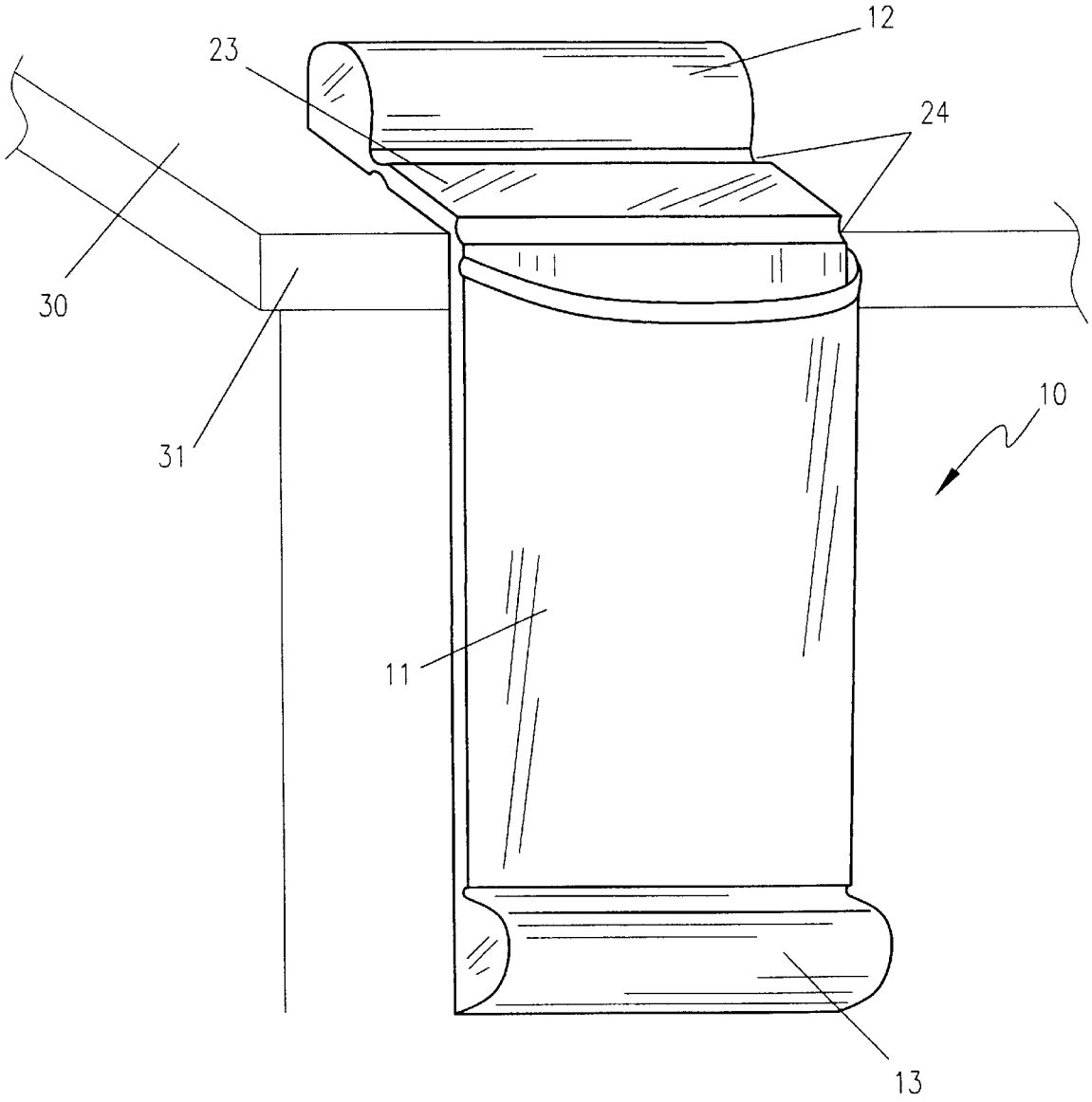
FIG. 4 is a perspective view of the anchoring eyeglass pouch depicting its use in suspending the pouch from a tabletop surface, according to the preferred embodiment of the present invention.
Figure 5:
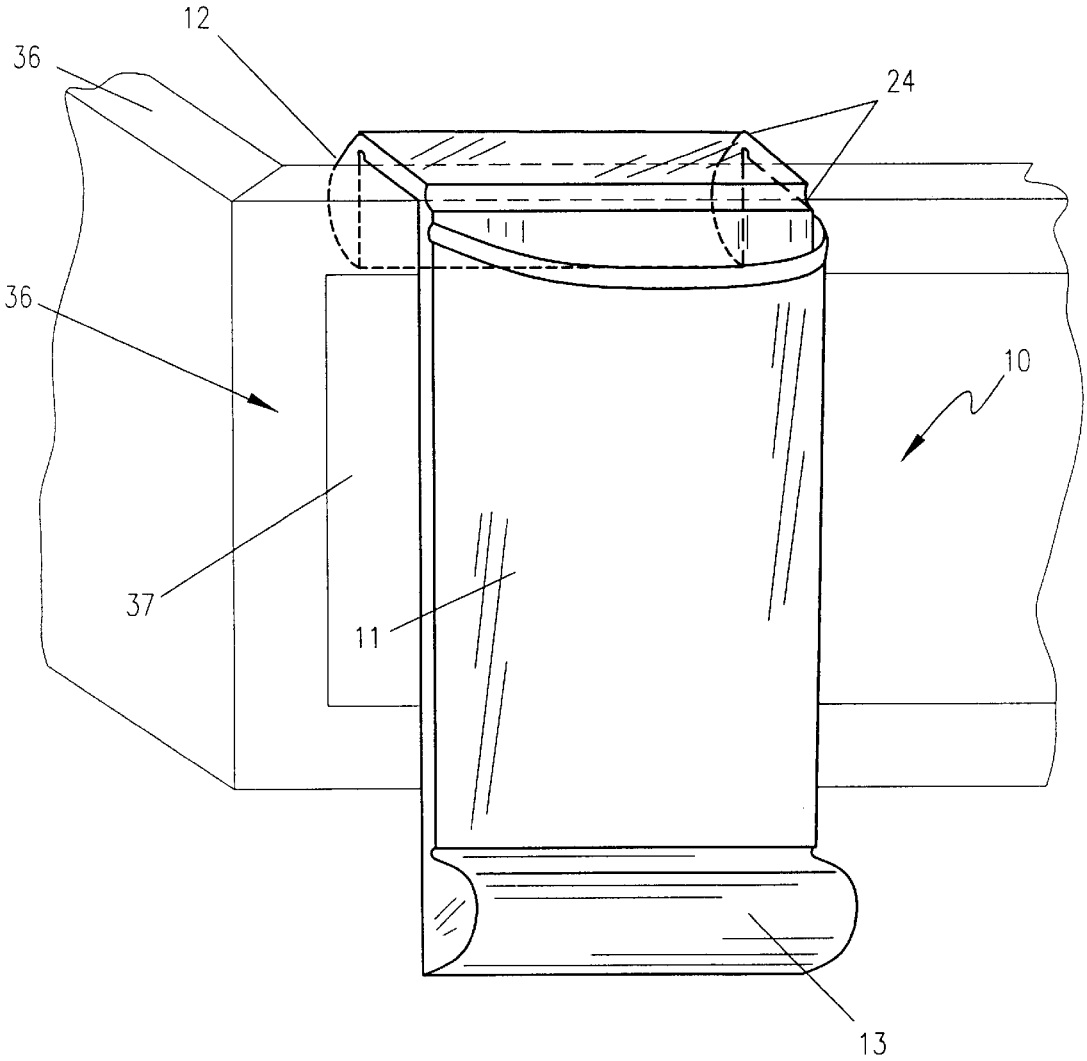
FIG. 5 is a perspective view of the anchoring eyeglass pouch depicting its use in suspending the pouch from a drawer, according to the preferred embodiment of the present invention.

In accordance with the preferred embodiment of the present invention and as shown in FIGS. 4–5, the eyeglass pouch 10 is used to support a pair of eyeglasses 15 in a variety of manners.

Referring now to FIG. 4, the eyeglass pouch 10 is depicted, supported from a conventional tabletop 30 or other like generally flat horizontal surface. In this use, the anchoring portion 12 and the hinging portion 23 lie flat on the tabletop 30 surface with the pouch portion 11 suspended vertically from the tabletop edge 31. The hinging reliefs 24 allow for the pivotal action between the pouch portion 11 and the hinging portion 23, thus facilitating the perpendicular orientation therebetween. The anchoring portion 12 serves to secure the eyeglass pouch 10 to the tabletop 30, the anchoring weight 20 causing a friction fit therewith that prevents the anchoring eyeglass pouch 10 from sliding off the tabletop edge 31 under its own weight. The stabilizing portion 13 provides ballast that helps ensure that the pouch portion 11 maintains a stable vertical orientation, perpendicular to the tabletop 30. Due to this orientation, the weight of the pouch portion 11 and stabilizing portion 13 suspended from the tabletop 30 rests, to a great extent, perpendicular to the tabletop 30, thus minimizing any weight component that would tend to cause the eyeglass pouch 10 to slip off the tabletop 30.

Referring now to FIG. 5, the eyeglass pouch 10 is depicted, supported from a conventional drawer 35 or other like structure. In this use, the hinging portion 23 lies flat on the upper drawer edge 36 with the anchoring portion 12 suspended inside the drawer 35 and with the pouch portion 11 suspended vertically from the upper drawer edge 36 on the outside of the drawer 35. The hinging reliefs 24 allow for the pivotal action between the pouch portion 11 and the hinging portion 23 as well as between the anchoring portion 12 and the hinging portion 23, thus facilitating the perpendicular orientation, respectively, therebetween. As with the tabletop 30 application, the anchoring portion 12 serves to secure the eyeglass pouch 10 to the drawer 35, the anchoring weight 20 causing a friction fit between the hinging portion 23 and the upper drawer edge 36 that prevents the anchoring eyeglass pouch 10 from sliding or otherwise falling from the drawer 35 under its own weight. The stabilizing portion 13 provides ballast that helps ensure that the pouch portion 11 maintains a stable vertical orientation, parallel and along the drawer facade 37. Due to this orientation, the weight of the pouch portion 11 and stabilizing portion 13 suspended from the drawer 35 rests, to a great extent, perpendicular to the drawer 35, thus minimizing any weight component that would tend to cause the eyeglass pouch 10 to slip off the drawer 35.

Other anchoring scenarios (not shown in the figures) allow the eyeglass pouch 10 to be suspended from a variety of surfaces. Use of the securing clip 25 allows the eyeglass pouch 10 to be secured to a shirt pocket, automobile visor, purse, etc. Incorporation of a magnet as the anchoring weight 20 allows the eyeglass pouch 10 to be suspended from steel or other ferrous structures and surfaces.

While the preferred embodiments of the invention have been shown, illustrated, and described, it will be apparent to those skilled in this field that various modifications may be made in these embodiments without departing from the spirit of the present invention. It is for this reason that the scope of the invention is set forth in and is to be limited only by the following claims.

What is claimed is:

1. An anchoring eyeglass pouch comprising:

a protective pouch for storing and protecting conventional eyeglasses; and an anchoring means pivotally connected to a first end of said protective pouch, said anchoring means causing a frictional engagement with a support structure thus allowing said protective pouch to be suspended therefrom, wherein said anchoring means, said protective pouch, are generally more rigid than flexible, said anchoring means separated from said protective pouch by a hinged portion defined pair of hinging means running parallel to one another and oriented perpendicular to the longitudinal axis of said anchoring eyeglass pouch, said hinging means allowing said anchoring means, said hinged portion and said protective pouch to pivot with respect to one another; and a first support clamping means attached to said first end and a second support clamping means attached to a second end of said protective pouch, said first and second support clamping means allowing said anchoring eyeglass pouch to be attached to a shirt pocket, purse, automobile visor or other object.

2. The anchoring eyeglass pouch of claim 1, wherein said anchoring means further comprises a ferromagnetic material, allowing said anchoring eyeglass pouch to be suspended from a ferrous structure.

3. The anchoring eyeglass pouch of claim 1 further comprising:

a stabilizing means connected to said second end of said protective pouch, said stabilizing means providing ballast and stabilizing said protective pouch when suspended in a vertical orientation.

4. The anchoring eyeglass pouch of claim 1, wherein resting said anchoring means on a support structure creates a frictional force therewith that allows said protective pouch to be suspended from the edge of said support structure, said hinging means allowing said protective pouch to pivot about and hang over said edge of said support structure, said protective pouch assuming a generally vertical orientation and stabilized by said stabilizing means.

5. The anchoring eyeglass pouch of claim 1, further comprising a securing clip for providing an additional means by which to support the eyeglass pouch.

* * * * *